US008043077B2

(12) United States Patent
Miyazaki

(10) Patent No.: US 8,043,077 B2
(45) Date of Patent: Oct. 25, 2011

(54) MICROPUMP

(75) Inventor: Hajjime Miyazaki, Matsumoto (JP)

(73) Assignee: Seiko Epson Corporation (JP)

( * ) Notice: Subject to any disclaimer, the term of this patent is extended or adjusted under 35 U.S.C. 154(b) by 688 days.

(21) Appl. No.: 12/191,329

(22) Filed: Aug. 14, 2008

(65) Prior Publication Data

US 2009/0060755 A1 Mar. 5, 2009

(30) Foreign Application Priority Data

Aug. 30, 2007 (JP) ..... 2007-223561
May 15, 2008 (JP) ..... 2008-128029

(51) Int. Cl.
*F04B 43/08* (2006.01)
*F04B 43/12* (2006.01)

(52) U.S. Cl. ..... 417/477.3

(58) Field of Classification Search ..... 417/212, 417/474, 478, 479; 604/131, 890.1–892.1, 604/65–67

See application file for complete search history.

(56) References Cited

U.S. PATENT DOCUMENTS 2,007,246 A * 7/1935 Goldberg et al. ..... 123/41 R
2,297,090 A * 9/1942 Weaver ..... 74/567
3,818,771 A * 6/1974 Kobelt ..... 74/99 R
5,575,631 A * 11/1996 Jester ..... 417/474
5,630,710 A * 5/1997 Tune et al. ..... 417/326
5,683,233 A * 11/1997 Moubayed et al. ..... 417/474
6,164,921 A * 12/2000 Moubayed et al. ..... 417/44.1
6,860,724 B2 * 3/2005 Cho et al. ..... 417/218
7,819,643 B2 * 10/2010 Miyazaki et al. ..... 417/477.3
7,950,908 B2 * 5/2011 Miyazaki et al. ..... 417/474
2008/0304982 A1 * 12/2008 Miyazaki et al. ..... 417/412
2011/0034900 A1 * 2/2011 Yodfat et al. ..... 604/500

FOREIGN PATENT DOCUMENTS

JP 2001-515557 9/2001
WO WO 9116542 A1 * 10/1991

* cited by examiner

*Primary Examiner* — Devon C Kramer
*Assistant Examiner* — Ryan Gatzemeyer
(74) *Attorney, Agent, or Firm* — Harness, Dickey & Pierce, P.L.C.

(57) ABSTRACT

A micropump that includes: a tube frame including an elastic tube, and a tube guide groove; a cam drive wheel which moves in response to a motor that can be rotated in forward and reverse directions; a first cam is provided with a finger depression section at a circumferential portion thereof; a second cam is provided with a finger depression section at a circumferential portion thereof; and a plurality of fingers provided between the tube and the respective finger depression sections of the first and second cams. The micropump can be in a first state of continuously feeding a fluid by when the first cam is rotated in the forward direction, the first cam pushing and rotating the second cam in the same direction, a second state of rotating only the first cam in the reverse direction, and a third state of stopping the first cam from rotating.

16 Claims, 8 Drawing Sheets

MICROPUMP

CROSS REFERENCE TO RELATED ART

The disclosure of Japanese Patent Applications No. 2007-223561 filed on Aug. 30, 2007 and No. 2008-128029 filed on May 15, 2008 including specification, drawings and claims is incorporated herein by reference in its entirety.

BACKGROUND

1. Technical Field

The present invention relates to the configuration of a micropump that feeds a fluid through an elastic tube by sequentially opening and closing the tube through depression over a plurality of fingers by rotation of a cam.

2. Related Art

A previously-known fluid transfer device is a peristaltic pump that feeds a fluid by squeezing a tube. In the peristaltic pump, the tube is disposed along a platen curved concave, and in the vicinity of the platen and the tube, a cam is disposed. Between the cam and the tube, a plurality of fingers are disposed. With such a configuration, when the cam is rotated, the fingers are responsively depressed sequentially in the direction of the tube, whereby the tube is squeezed and a fluid is fed. With such a fluid transfer device, the platen is attached to the tube body so that the tube is detachably disposed between the fingers and the platen. An example includes Patent Document 1 (JP-T-2001-515557).

With such a peristaltic pump of Patent Document 1, the tube is attached to the concave portion of the platen by insertion, and the resulting platen is then attached to the tube body by insertion, thereby putting the peristaltic pump in a state available for driving. The concern with such a peristaltic pump is that, however, with the tube being disposed between the platen and the fingers, some of the fingers are always closing or depressing the tube. With such a configuration, before driving of such a peristaltic pump, or when the tube remains depressed at any specific portion for a long period of time, e.g., when the pump has been in the halting state, the tube remains deformed, thereby preventing the feeding of the fluid. There is also a problem that any desired amount of flow for feeding cannot be derived because the tube does not return to its original shape.

Herein, although the tube is detachably attached to the pump body, attaching/detaching the tube at the time of driving or stopping may cause operational inconvenience, or may invite human errors at the time of attachment/detachment thereof. Moreover, even if the peristaltic pump is made water resistant, repeating such tube attachment/detachment results in a difficulty for the pump to remain water resistant inside.

Furthermore, when such a peristaltic pump is disposed at a position where such tube attachment/detachment is difficult, e.g., in a living body, the tube is hardly free from deformation and deterioration as described above because the tube remains attached to the pump body.

SUMMARY

An advantage of some aspects of the invention is to solve at least a part of the problems mentioned above and the invention can be configured as the follows.

A first aspect of the invention is directed to a micropump that includes: a tube frame including an elastic tube, and a tube guide groove for attachment of the tube in the form of an arc; a cam drive wheel whose rotation center is the same as an arc center of the tube guide groove, and moves in response to a motor that can be rotated in forward and reverse directions; a first cam that is axially fixed to a center axis of the cam drive wheel, and is provided with a finger depression section at a circumferential portion thereof; a second cam that is pivotally supported by the center axis of the cam drive wheel to be able to rotate, and is provided with a finger depression section at a circumferential portion thereof; and a plurality of fingers provided between the tube and the respective finger depression sections of the first and second cams radially from the rotation center. The micropump can be in first to third states, i.e., the first state of continuously feeding a fluid by, when the first cam is rotated in the forward direction, the first cam pushing and rotating the second cam in the same direction, by the finger depression sections of the first and second cams respectively depressing the fingers one by one, and by the fingers sequentially closing and opening the tube repeatedly from a fluid inflow side to a fluid outflow side, the second state of rotating only the first cam in the reverse direction at a time of, in the first state, a detection of a position where the finger depression section of the second cam releases the tube from depression by the fingers, and the third state of stopping the first cam from rotating at a time of, in the second state, a detection of a position where the first cam releases the tube from depression by the fingers. The first state is retained by a drive command coming from the micropump being in the third state.

The operation cycle of the first state, the second state and the third state is performed when the micropump is stopped for a long period of time.

With such a configuration, when the micropump is not driven for a long period of time, the micropump remains in the third state of not depressing the tube, thereby being able to solve the previous problems, e.g., the feeding of a fluid is prevented because the tube remains deformed due to the continuous depression at any specific portion of the tube, and any desired amount of flow for feeding cannot be derived because the tube does not return to its original shape. With the problems solved as such, the fluid can be fed with any predetermined amount of flow.

What is better, for creating the third state of not depressing the tube, the configuration does not require the operation of detaching the tube from the micropump body. As such, because the tube attachment/detachment is not required unlike the previous technologies, the possibility of causing any operation error by such an operation can be favorably eliminated, and thus the pump can remain water resistant inside.

In a second aspect of the invention, in the micropump of the first aspect, preferably, the first cam is provided with a rotation position detection mark. The micropump further includes: a first detector that detects whether, in the first state, the rotation position detection mark reaches the position where the second cam releases the tube from depression by the fingers; and a second detector that detects whether, in the second state, the rotation position detection mark reaches the position where the first cam releases the tube from depression by the fingers.

With such a configuration, the first and second cams are rotated in the forward direction, i.e., first state, and when the rotation position detection mark is detected by the first detector, only the first cam is rotated in the reverse direction, i.e., second state. This detection position is where the finger depression section of the second cam releases the tube from depression by the fingers. Thereafter, when the second detector detects the rotation position detection mark of the first cam rotating in the reverse direction, the driving of the first cam is stopped, i.e., third state. This driving-stop position of the first cam is where the first cam releases the tube from depression by the fingers. Accordingly, both the first and second cams remain in the state of not closing the tube.

As such, by the rotation position detection mark and the first and second detectors, the rotation positions of the first and second cams can be respectively detected with accuracy so that the micropump can remain in the third state of not closing the tube. The micropump being remained in the third state as such favorably solves the previous problems, e.g., if the tube is kept depressed at any specific portion, the feeding of a fluid is prevented because the tube remains deformed thereby, and any desired amount of flow for feeding cannot be derived because the tube does not return to its original shape. With the problems solved as such, the fluid can be fed with any predetermined amount of flow.

Moreover, the operation cycle for a state change of the micropump, i.e., from the first to third states, is performed in response to a detection by the first and second detectors. This accordingly eliminates the need for any troublesome operation, e.g., removing the tube from the micropump body, and releasing the tube from depression.

In a third aspect of the invention, in the micropump of the first aspect, preferably, the first and second cams are respectively provided with a rotation position detection mark. The micropump further includes: a third detector that detects whether, in the first state, the rotation position detection mark of the second cam reaches the position where the second cam releases the tube from depression by the fingers; and a second detector that detects whether, in the second state, the rotation position detection mark of the first cam reaches the position where the first cam releases the tube from depression by the fingers.

Such a configuration allows a detection of the position where the finger depression section of the second cam releases the tube from depression by the fingers using the rotation position detection mark of the second cam and the third detector. When the first cam is being rotated in the forward direction, the relative position between the rotation position detection marks of the first and second cams is defined by the design shape of the first and second cams. This thus allows to keep the third state in which only the first cam is rotated in the reverse direction, and the first cam is stopped from rotating when the position detection mark thereof is detected by the second detector, whereby the first and second cams both release the tube from depression by the fingers.

In a fourth aspect of the invention, in the micropump of the first aspect, preferably, the first cam is provided with a rotation position detection mark. The micropump further includes a first detector that detects whether, in the first state, the rotation position detection mark reaches the position where the second cam releases the tube from depression by the fingers. The motor is provided with the required number of drive pulses until, in the second state, the first cam located at the position detected by the first detector reaches the position of releasing the tube from depression by the fingers, and the motor is stopped.

With such a configuration, using the rotation position detection mark of the first cam and the first detector, the finger depression section of the second cam is detected as reaching the position of releasing the tube from depression by the fingers, and after the detection, only the first cam is rotated in the reverse direction. Herein, the amount of movement of the first cam until the finger depression section thereof reaches the position of releasing the tube from depression by the fingers is provided by the number of drive pulses of the motor. There is thus no more need to include the second and third detectors as described above, thereby favorably simplifying the configuration.

In a fifth aspect of the invention, in the micropump of the first aspect, preferably, the second cam is provided with a rotation position detection mark. The micropump further includes a third detector that detects whether, in the first state, the rotation position detection mark reaches the position where the finger depression section of the second cam releases the tube from depression by the fingers. The motor is provided with the required number of drive pulses until, in the second state, the first cam located at the position detected by the third detector reaches the position of releasing the tube from depression by the fingers, and the motor is stopped.

With such a configuration, using the rotation position detection mark of the second cam and the third detector, the finger depression section of the second cam is detected as reaching the position of releasing the tube from depression by the fingers, and after the detection, only the first cam is rotated in the reverse direction. Herein, the amount of movement of the first cam until the first cam reaches the position of completely releasing the tube from depression by the fingers is provided by the number of drive pulses of the motor. There is thus no more need to include the first and second detectors as described above, thereby favorably simplifying the configuration.

In a sixth aspect of the invention, in the micropump of any of the first to fifth aspects, preferably, the rotation position detection mark provided to the first or second cam is a light transmissive hole or a light reflection member, and any of the first to third detectors is a light sensing element.

In a seventh aspect of the invention, in the micropump of any of the first to fifth aspects, preferably, the rotation position detection mark provided to the first or second cam is a conductive member or an elastic member with conductivity. Any of the first to third detectors is an elastic member with conductivity or a conductive member. Through connection between the conductive member and the elastic member, a rotation position of the first or second cam is detected.

In an eighth aspect of the invention, in the micropump of any of the first to fifth aspects, preferably, the rotation position detection mark provided to the first or second cam is a magnet or a Hall device, and any of the first to third detectors is a Hall device or a magnet.

The micropumps of the sixth to eighth aspects are all simplified in configuration, and can detect the rotation positions of the first and second cams with good accuracy. Such detections are all made electrically, and there are thus advantages of easy feedback of such detections to driving of the motor.

In a ninth aspect of the invention, in the micropump of any of the first to eighth aspects, preferably, the micropump is detected as being stopped for a fixed length of time or longer, the micropump is activated to operate for the first to third states, and the first and second cams are respectively stopped at the positions of releasing the tube from depression by the fingers.

When the micropump is stopped during driving in the first state, and if the micropump remains stopped for a fixed length of time, e.g., several hours, the duration of stopping is detected, and then the operation cycle for a state change of the micropump, i.e., from the first to third states, is performed as described above. When the first and second cams both reach their positions for releasing the tube from depression by the fingers, the micropump is stopped in operation. This accordingly enables to keep the third state with no special operation for a state change of the micropump from the first to third states.

In a tenth aspect of the invention, in the micropump of any of the first to fifth aspects, preferably, a time for the first cam in the first state to rotate once is detected by any of the first to third detectors.

With such a configuration, the time needed for the first cam to rotate once is determined by setting values of the discharge speed, the rotation speed, and others. Therefore, detecting the rotation speed of the micropump in motion and comparing the detection result with the setting value can determine whether the micropump is being driven as expected.

In an eleventh aspect of the invention, in the micropump of the tenth aspect, preferably, a communications device is further provided for detecting the time for the first cam to rotate once, and for outputting a detection result.

The communications device is exemplified by a radio communications system or a cable communications system.

With such a configuration, the driving state of the micropump, i.e., rotation speed thereof, can be checked from the position away from the micropump, and yet the micropump can be stopped in operation when any abnormality is detected. This favorably leads to the high reliability, and is considered especially effective when the micropump is attached in a living body for giving fluid drug preparations thereby.

A twelfth aspect of the invention is directed to a micropump that includes: a tube frame including an elastic tube, and a tube guide groove for attachment of the tube in the form of an arc; a cam drive wheel whose rotation center is the same as an arc center of the tube guide groove, and moves in response to a motor that can be rotated in forward and reverse directions; a first cam that is axially fixed to a center axis of the cam drive wheel, and is provided with a finger depression section at a circumferential portion thereof; a second cam that is pivotally supported by the center axis of the cam drive wheel to be able to rotate, and is provided with a finger depression section at a circumferential portion thereof; and a plurality of fingers provided between the tube and the respective finger depression sections of the first and second cams radially from the rotation center. The micropump can be in first to third states, i.e., a first state of continuously feeding a fluid by, when the first cam is rotated in the forward direction, the first cam pushing and rotating the second cam in the same direction, by the finger depression sections of the first and second cams respectively depressing the fingers one by one, and by the fingers sequentially closing and opening the tube repeatedly from a fluid inflow side to a fluid outflow side, a second state of rotating only the first cam in the reverse direction at a time of, in the first state, a detection of a position where the finger depression section of the second cam releases the tube from depression by the fingers, and a third state of stopping the first cam from rotating at a time of, in the second state, a detection of a position where the first cam releases the tube from depression by the fingers. A communications device is provided, the positions in the second and third states are respectively detected by an external detector, and a detection result is provided via the communications device, and the micropump is operated for the first to third states.

This configuration enables, externally, the operation cycle for a state change of the micropump, i.e., from the first to third states, in accordance with the driving state of the micropump. There thus are effects of, after the micropump is checked for its feeding amount of fluid before shipment, for example, keeping the micropump in the third state until it is used by a user.

This configuration also eliminates the need for the micropump to carry therein a detector(s), whereby the resulting micropump can be simplified in configuration. This accordingly leads to the cost reduction of the micropump, and the economic effects can be increased for users when the micropump is thrown away after one use.

A thirteenth aspect of the invention is directed to a micropump that includes: a tube frame including an elastic tube, and a tube guide groove for attachment of the tube in the form of an arc; a cam drive wheel whose rotation center is the same as an arc center of the tube guide groove, and moves in response to a motor that can be rotated in forward and reverse directions; a first cam that is axially fixed to a center axis of the cam drive wheel, and is provided with a finger depression section at a circumferential portion thereof; a second cam that is pivotally supported by the center axis of the cam drive wheel to be able to rotate, and is provided with a finger depression section at a circumferential portion thereof; and a plurality of fingers provided between the tube and the respective finger depression sections of the first and second cams radially from the rotation center. In the micropump, calculations are made of the number of pulses, of the motor, needed for the first cam to rotate once, and for the first cam in an initial state to come in contact with the second cam, and from the total number of pulses driven from start to stop, a calculation is made of the number of pulses needed to bring the first and second cams to the positions when the motor is stopped, and to put the first and second cams in the initial state, and the initial state is creased by driving the motor in the forward or reverse direction.

In the thirteenth aspect, at the time of assembling a micropump, the initial state is created, i.e., the first and second cams are not depressing the tube. After calculations of the number of pulses, the motor is driven in the forward or reverse direction, and then is stopped when the micropump is put in the initial state. Calculated here are the number of pulses until the first cam being in the initial state comes to the position abutting the second cam, until the second cam is put in the initial state and then is stopped in operation, and until the first cam having been stopped from rotating is put back in the initial state. As such, the number of drive pulses is used as a basis to control each of the states, and therefore, the initial state of leaving the tube open can be created without using the rotation position detection mark(s) and the detector(s).

In a fourteenth aspect of the invention, in the micropump of the thirteenth aspect, preferably, after continuous driving until a predetermined rotation frequency is derived for the first cam through repeated closing and opening of the tube in the initial state sequentially from a fluid inflow side to a fluid outflow side, the motor is stopped after being provided with, additionally, the number of drive pulses needed for the second cam to be in the initial state, and then with the number of drive pulses needed for the first cam rotating in the reverse direction to reach a position of the initial state.

With such a configuration, the initial state is created when a micropump is assembled. When the first cam reaches a predetermined rotation frequency, i.e., reaches a predetermined amount of flow, the motor is driven with an input of drive pulses needed to put the second cam in the initial state and then is stopped from rotating. Thereafter, the first cam is rotated in the reverse direction, and with an input of drive pulses needed to bring the first cam to the position of the initial state, the motor is stopped. As such, the motor is driven in accordance with the number of drive pulses needed for a state change, the initial state of leaving open the tube can be created after driving of the motor.

In a fifteenth aspect of the invention, in the micropump of the thirteenth aspect, preferably, after continuous driving until a predetermined rotation frequency is derived for the first cam through repeated closing and opening of the tube in the initial state sequentially from a fluid inflow side to a fluid outflow side, the motor is provided with, additionally, the number of drive pulses needed for the second cam to be in the initial state, and the motor is rotated in the reverse direction to detect a condition of not being able to rotate any more due to an excessive motor load as a result of engagement between the second cam and the finger at the tail in a fluid-feeding direction, and the initial state is created by stopping the motor.

With such a configuration, first of all, the micropump in the initial state is driven to move only the second cam to the position of initial state. When the first cam is rotated in the reverse direction with the second cam being at the position, the second cam is pushed and thus starts rotating also in the reverse direction. During rotation as such, the second cam is engaged with the finger at the tail in the direction of fluid feeding, and thus is not allowed to rotate more. This imposes the excessive load on the motor, thereby causing fluctuations in the waveform of reverse-induced current, which is generated due to the rotation of the motor. When any change is detected in the waveform of reverse-induced current, the input of the drive pulses to the motor is stopped. As such, when the first cam is being stopped from rotating, the first and second cams are brought to the positions of the initial state, thereby keeping the state of releasing the tube from depression.

In a sixteenth aspect of the invention, in the micropump of any one of the thirteenth to fifteenth aspects, preferably, the motor is detected as being stopped during driving of the micropump or as being remained stopped for a fixed length of time or longer, and the initial state is created by rotating the motor in the forward or reverse direction from each of the number of drive pulses.

When the motor is intentionally stopped while driving the micropump, or when the halting state lasts for a fixed length of time, e.g., several hours, the duration of stopping is detected, and the second cam can be automatically put back in the initial state with no special operation. As such, the first and second cams can remain in the initial state of releasing the tube from depression by the fingers, thereby being able to solve previous problems, e.g., if the tube is kept depressed at any specific portion, the feeding of a fluid is prevented because the tube remains deformed thereby, and any desired amount of flow for feeding cannot be derived because the tube does not return to its original shape.

BRIEF DESCRIPTION OF THE DRAWINGS

The invention will be described with reference to the accompanying drawings, wherein like numbers reference like elements.

DESCRIPTION OF EXEMPLARY EMBODIMENTS

In the below, embodiments of the invention are described by referring to the accompanying drawings.

Figure 4:
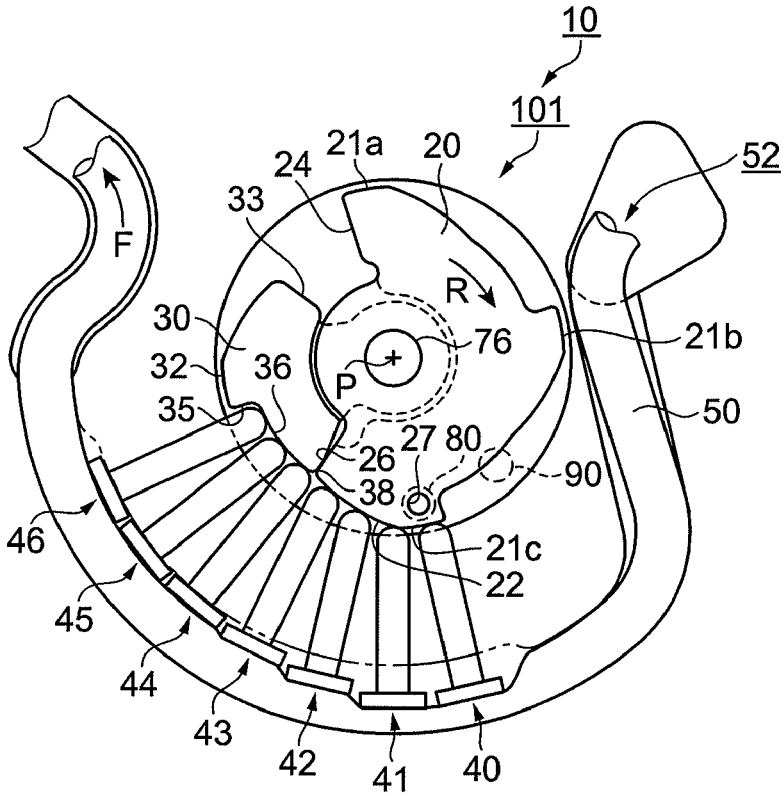
FIG. 4 is a partial plan view of a fluid transfer mechanism in the first embodiment, partially showing a second state thereof.
Figure 5:
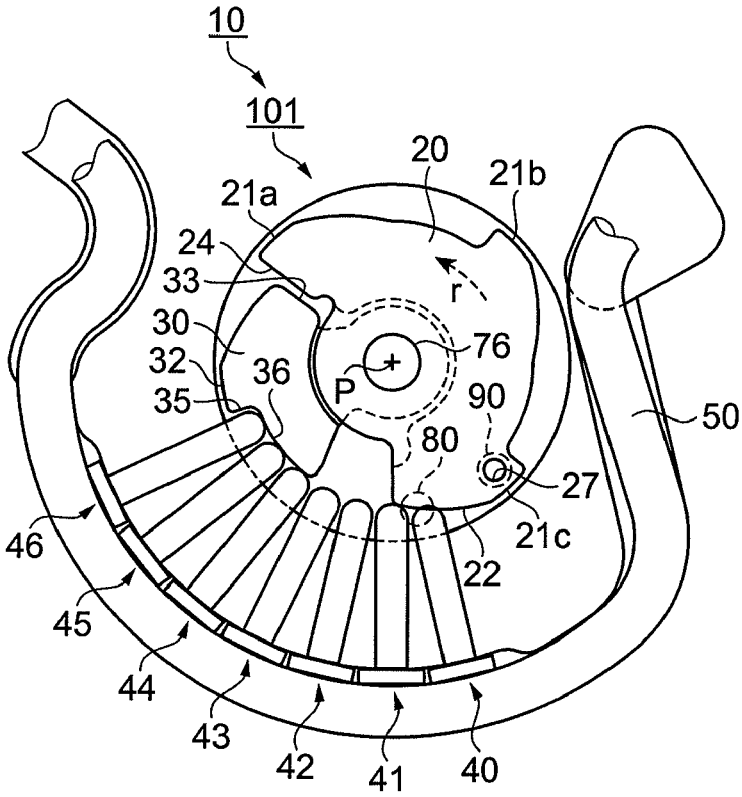
FIG. 5 is a partial plan view of the fluid transfer mechanism in the first embodiment, partially showing a third state thereof.
Figure 6:
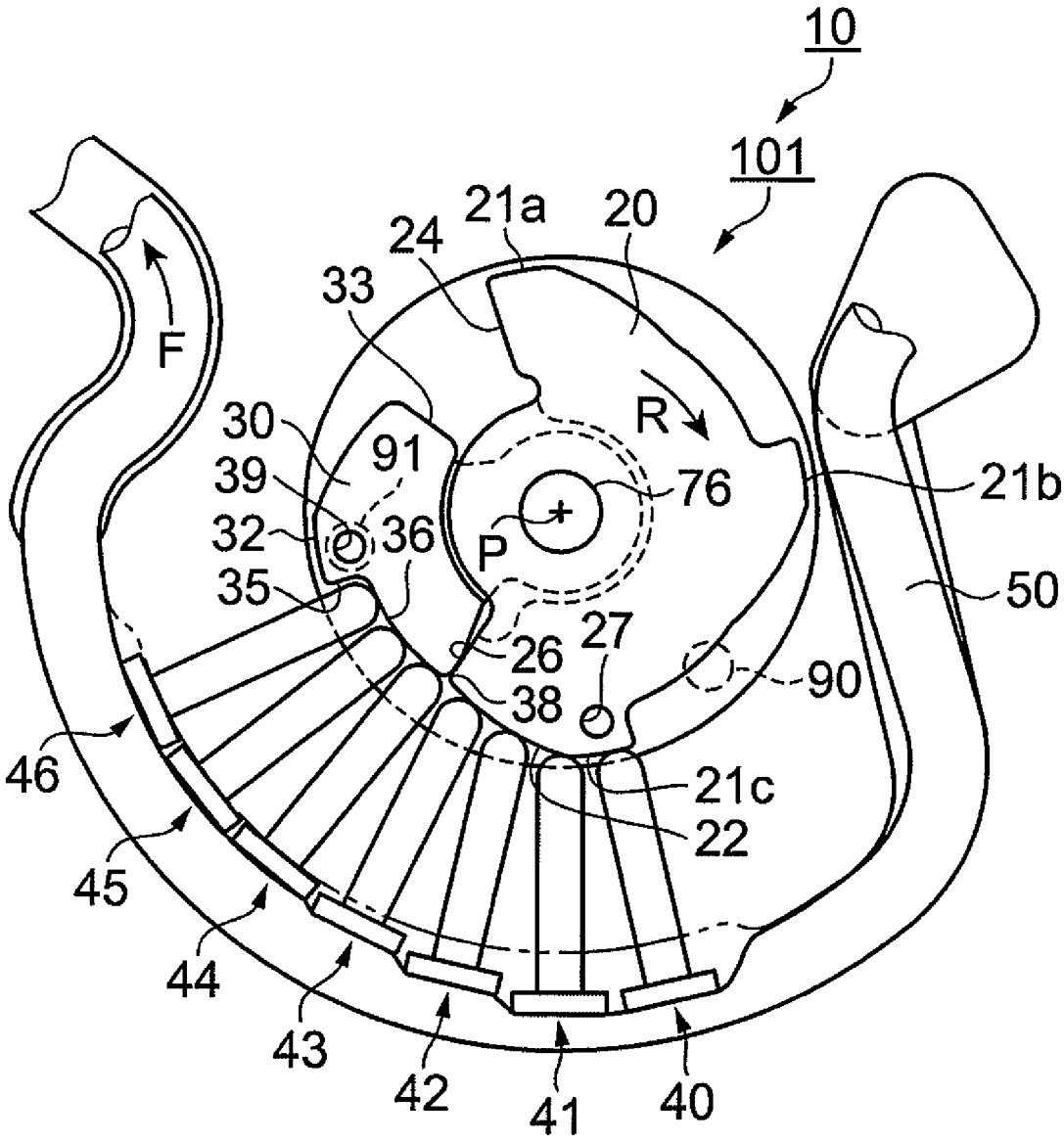
FIG. 6 is a partial plan view of a fluid transfer mechanism in a second embodiment, partially showing a second state thereof.
Figure 7:
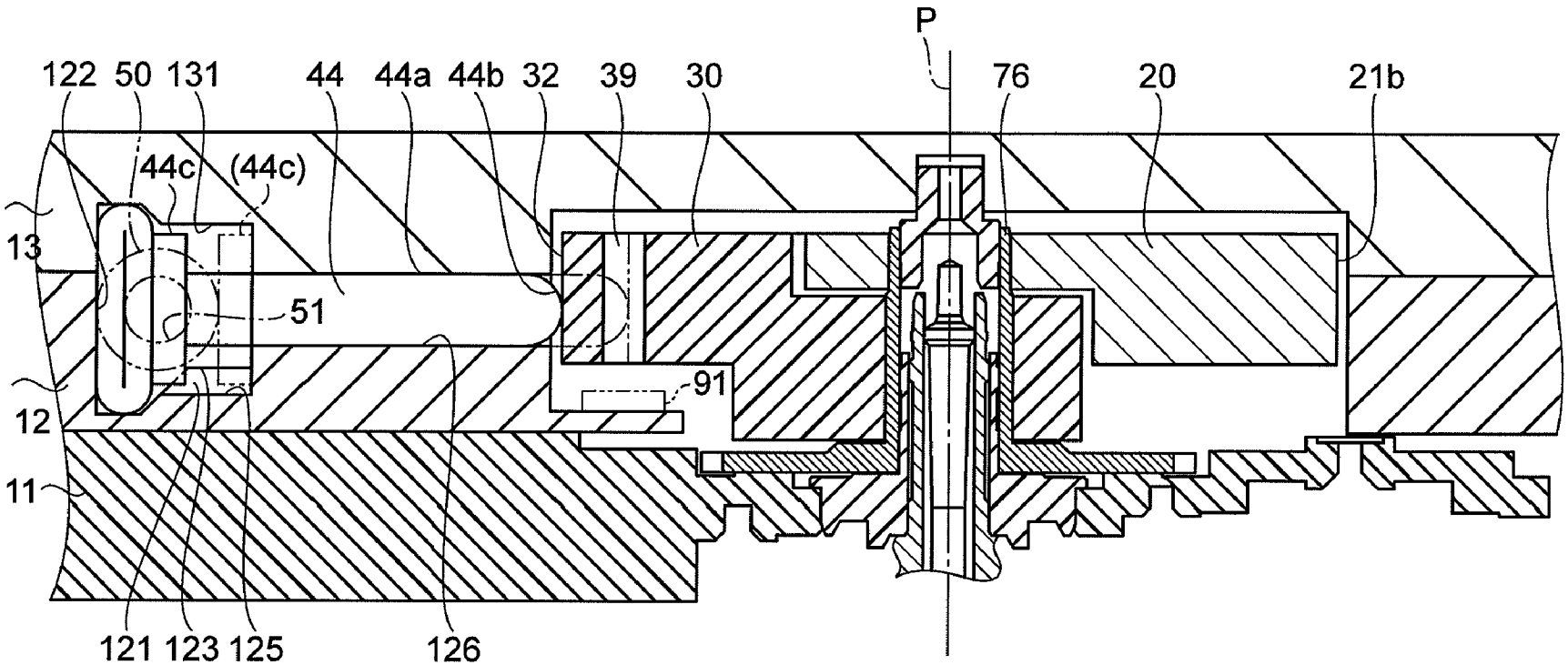
FIG. 7 is a partial cross-sectional view of the fluid transfer mechanism of FIG. 6.
Figure 8:
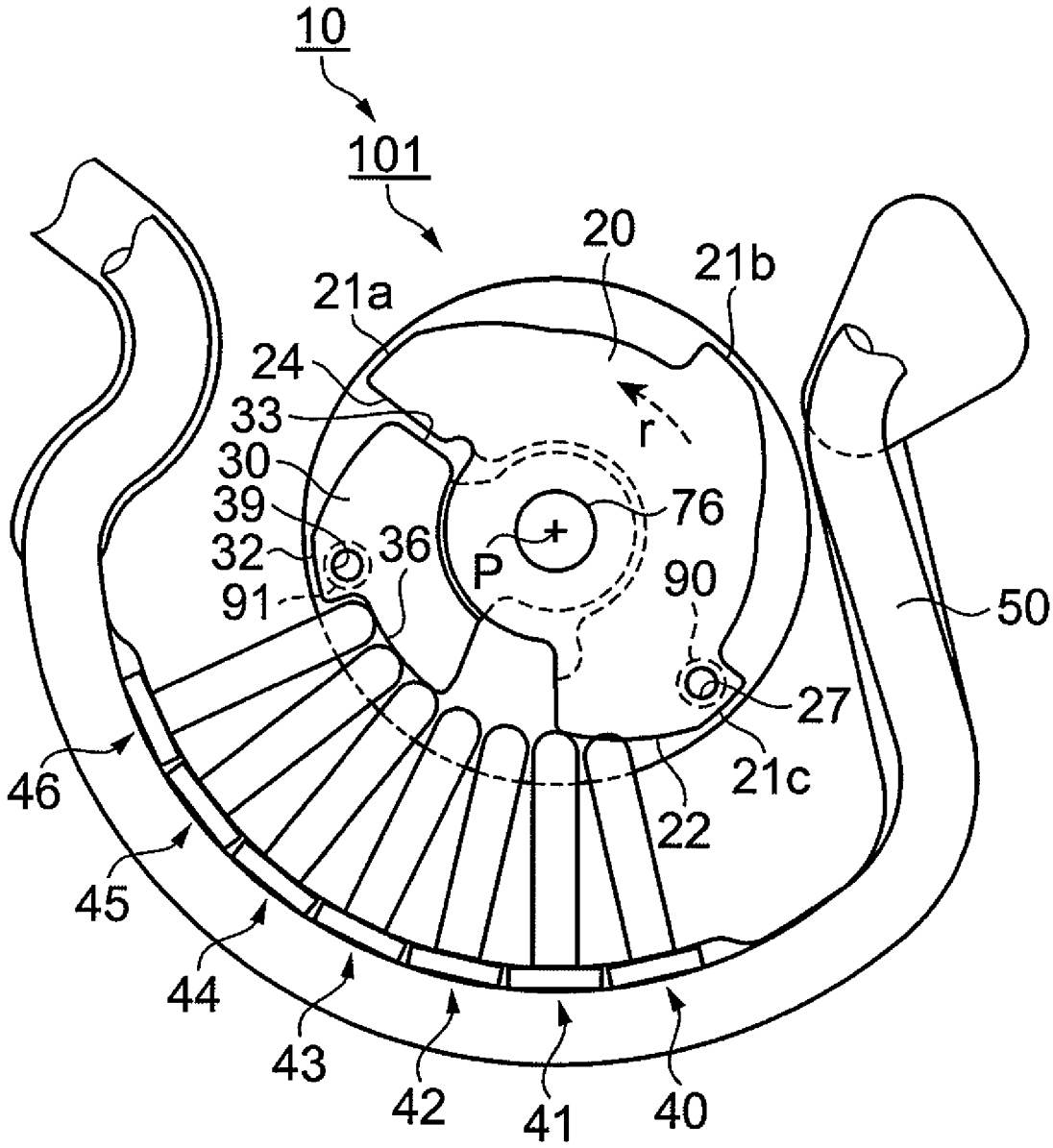
FIG. 8 is a partial plan view of the fluid transfer mechanism in the second embodiment, partially showing a third state thereof.
Figure 9:
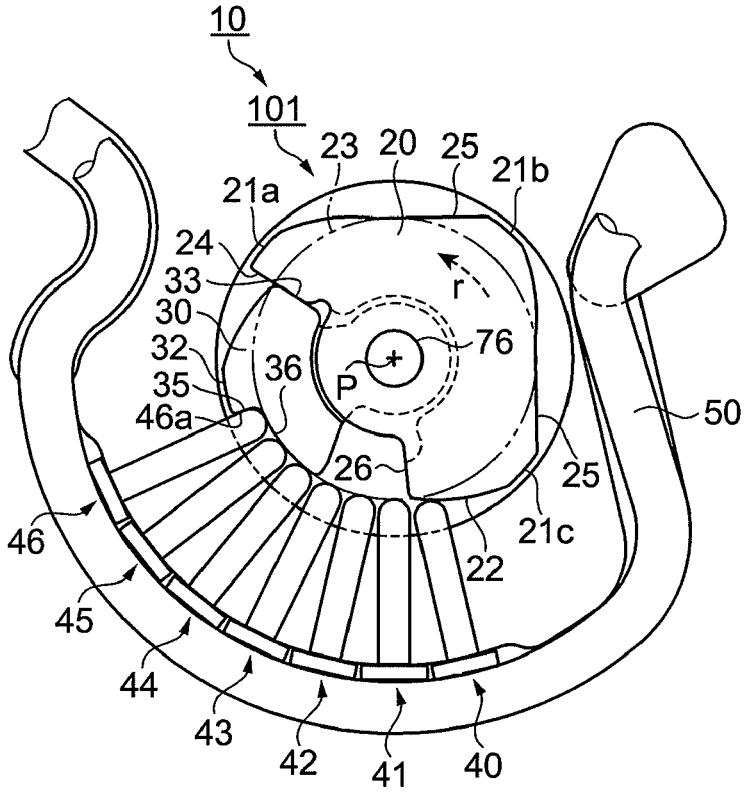
FIG. 9 is a partial plan view of first and second cams in a tenth embodiment, showing an initial state thereof.
Figure 10:
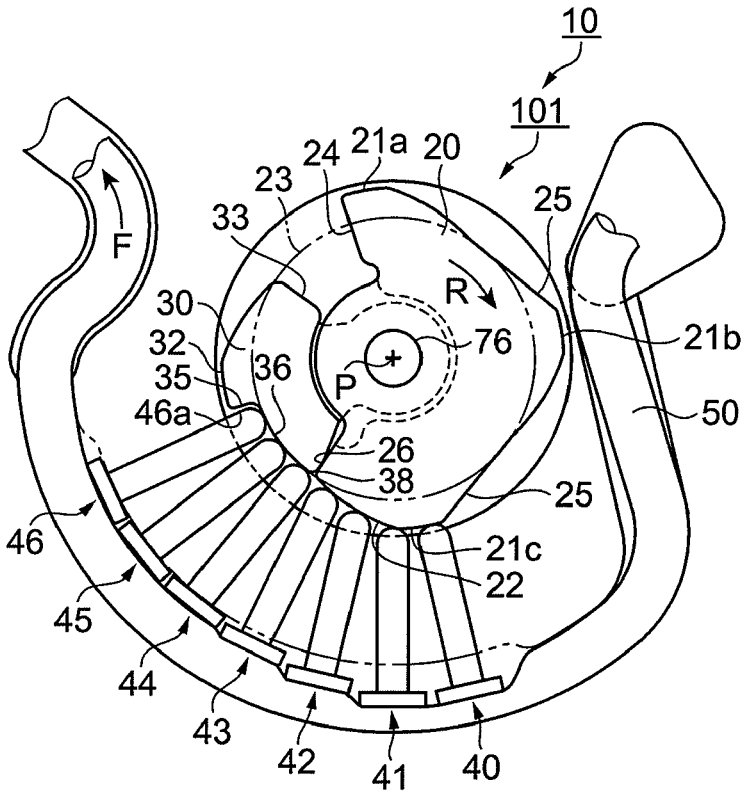
FIG. 10 is a partial plan view of the second cam in the tenth embodiment, showing the state in which only the second cam is rotated to the position of the initial state.

FIGS. 1 to 5 each show a micropump of a first embodiment, FIGS. 6 to 8 each show a micropump of a second embodiment, and FIGS. 9 and 10 each show a micropump of a tenth embodiment.

Note that, for convenience, the drawings to be referred to in the below are those schematic with the size scale of components and sections being different from the actual.

First Embodiment

Figure 1:
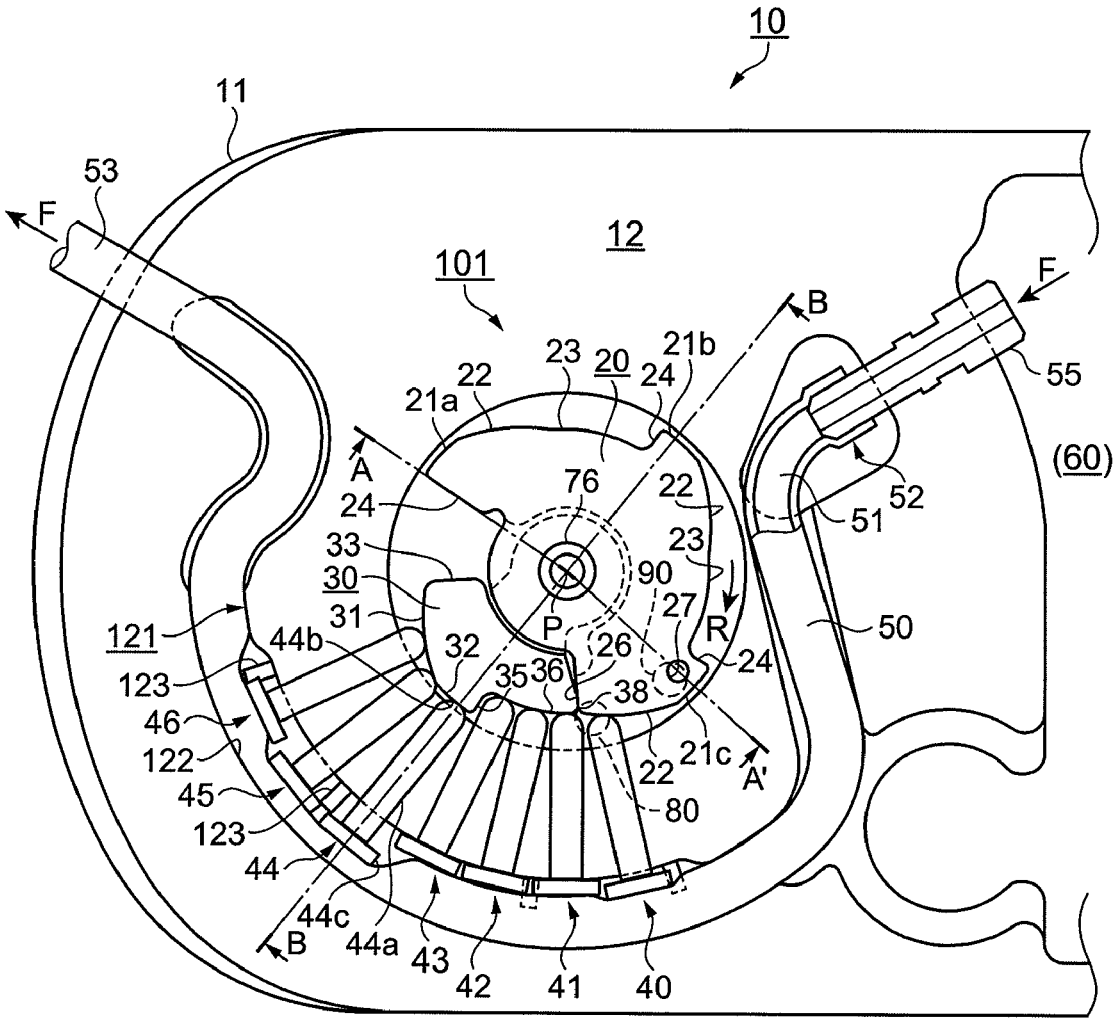
FIG. 1 is a plan view of a part of a micropump in a first embodiment.
Figure 2:
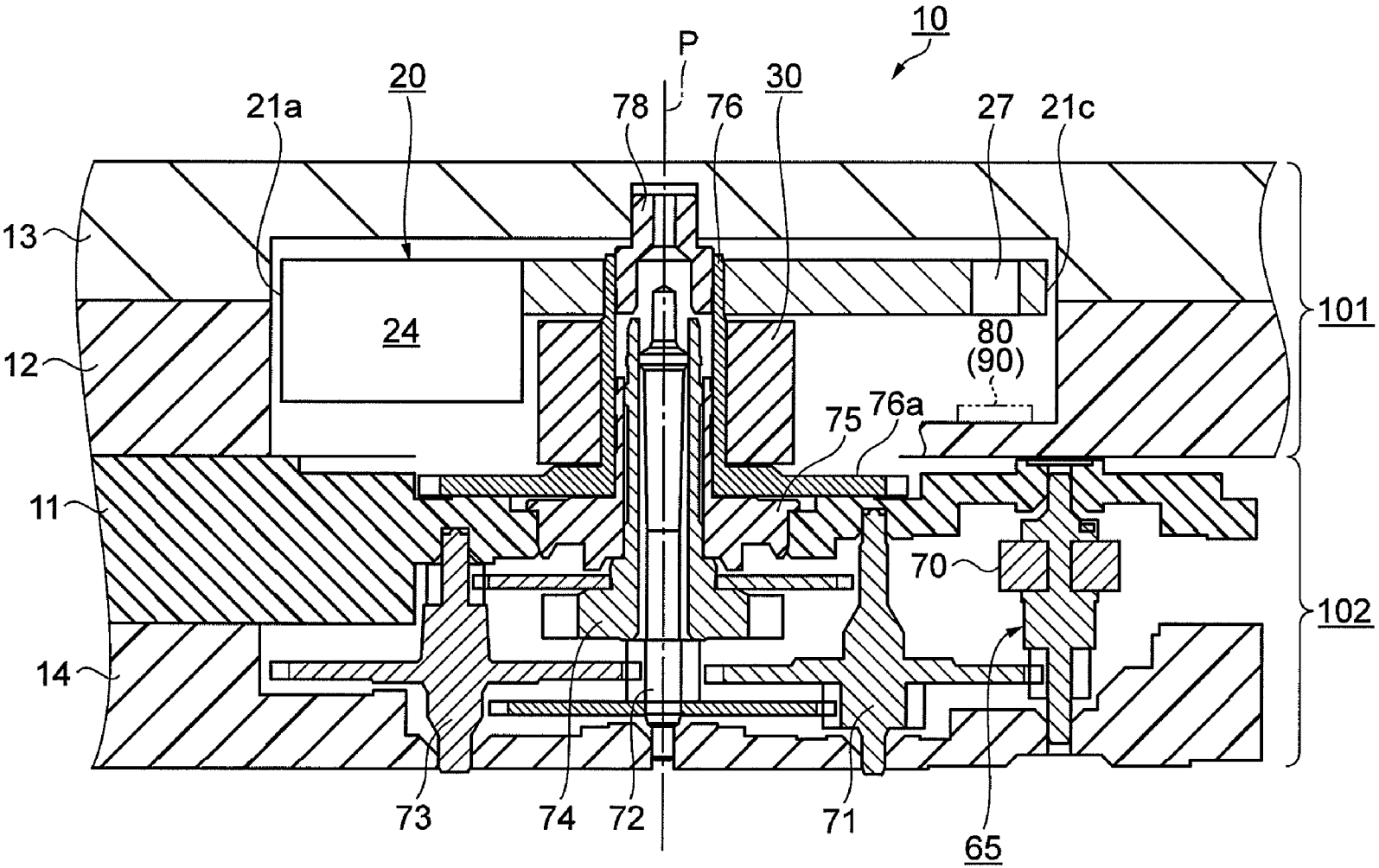
FIG. 2 is a partial cross-sectional view of the micropump of FIG. 1, showing the plane cut along a line A-P-A'.
Figure 3:
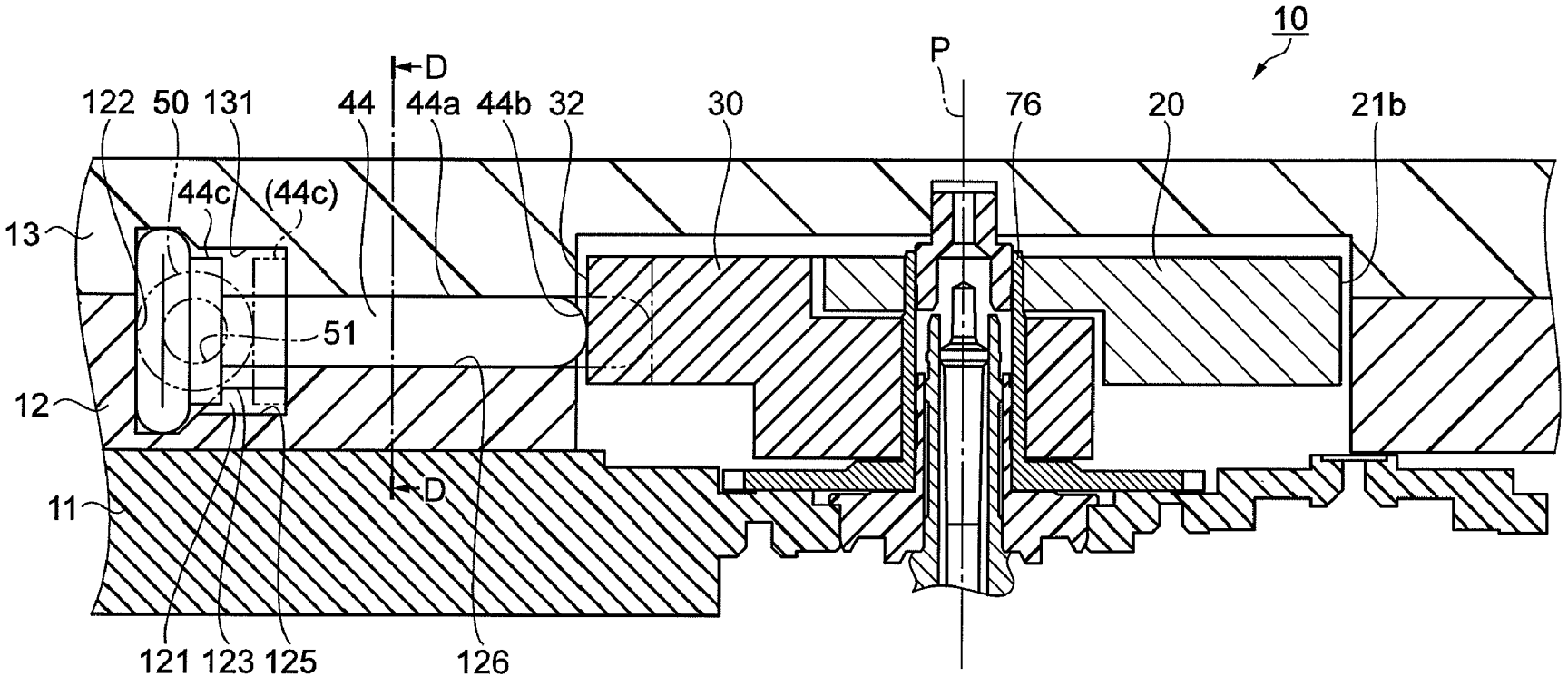
FIG. 3 is a partial cross-sectional view of the micropump of FIG. 1, showing the plane cut along a line B-B.

FIG. 1 is a plan view of a part of the micropump in the first embodiment of the invention. FIG. 2 is a partial cross-sectional view of the micropump of FIG. 1, showing the plane cut along a line A-P-A', and FIG. 3 is a partial cross-sectional view of the micropump of FIG. 1, showing the plane cut along a line B-B. Note that, FIGS. 1 to 3 each show a first state in which the micropump is in the state of constant driving. By referring to FIGS. 1 and 2, the main configuration of the micropump in the first embodiment is described. In FIGS. 1 and 2, a micropump 10 in the first embodiment is basically configured to include a fluid transfer mechanism 101, and a drive transmission section 102 serving to transmit the driving force to the fluid transfer mechanism 101. The fluid transfer mechanism 101 is provided with a tube 50 for feeding a fluid, and rotates first and second cams 20 and 30 by the driving force coming from the drive transmission section 102 so that the fluid is fed while the tube 50 is being sequentially closed and opened repeatedly from the fluid inflow side to the fluid outflow side.

By referring to FIG. 2, described first is the configuration of the drive transmission section 102. FIG. 2 is a partial cross-sectional view of the micropump of FIG. 1, showing the plane cut along a line A-P-A'. In FIG. 2, the drive transmission section 102 is provided with a step motor 65 for use as a drive source. In the step motor 65, the rotation of a step rotor 70 is transmitted to a cam drive wheel 76 by continuous meshing of first to fourth transmission wheels 71, 72, 73, and 74. The step motor 65 is configured to include the step rotor 70, and a stator and a coil (both not shown), and is allowed to rotate in both forward and reverse directions. The step rotor 70 is a four-pole permanent magnet.

These components, i.e., the step rotor 70, and the first, third, and fourth transmission wheels 71, 73, and 74, are pivotally supported by first and second frames 11 and 14 to be able to rotate. To the first frame 11, a transmission wheel shaft 75 is provided upright, and a tubular portion thereof is protruding upward, i.e., the direction along which the first and second cams 20 and 30 are provided. The transmission wheel shaft 75 is formed with a through hole, into which the tubular portion of the fourth transmission wheel 74 is inserted. The fourth transmission wheel 74 is also formed with a through hole, into which the shaft portion of the second transmission wheel 72 is inserted.

As to the second transmission wheel 72, one support shaft is pivotally supported by the second frame 14, and the other shaft portion is pivotally supported by the through hole of the fourth transmission wheel 74. The rotation of the fourth transmission wheel 74 is transmitted to the cam drive wheel 76 via a fifth transmission wheel that is not shown.

The cam drive wheel 76 is pivotally supported by a through hole at the center being inserted to the circumferential area of the tubular portion of the transmission wheel shaft 75. The shaft portion of the cam drive wheel 76 is protruding in the direction along which the first and second cams 20 and 30 are disposed. The cam drive wheel 76 is pivotally supported, at the upper shaft portion thereof, by a cam drive wheel support bearing 78 that is provided upright to a lid body 13. This lid body 13 is drilled with a hole for pivotally supporting the cam drive wheel support bearing 78. This hole is not going through the lid body 13, and the end portion of the cam drive wheel support bearing 78 is sealed by the lid body 13. In the cam drive wheel 76, the rotation of the step rotor 70 is reduced in speed down to a predetermined value by the above-described transmission wheels.

Note that the cam drive wheel 76 is pivotally supported by the transmission wheel shaft 75 and the cam drive wheel support bearing 78. The distance between sections in charge of supporting is thus increased, thereby suppressing the amount of tilt of the cam drive wheel 76. As such, any lateral pressure to be applied to the shaft portion of the cam drive wheel 76 can be reduced. The lateral pressure is the one to be generated by the load torque of the first and second cams 20 and 30 that will be described later.

By referring to FIG. 2, described next is the cross-sectional configuration of the fluid transfer mechanism 101. The fluid transfer mechanism 101 is disposed on the upper surface side of the first frame 11 with an overlay on the above-described drive transmission section 102. To the protruding shaft portion of the cam drive wheel 76, the second and first cams 30 and 20 are attached by insertion from the lower portion thereof in this order. Herein, the second cam 30 is pivotally supported by the cam drive wheel 76 with play therefrom, and the first cam 20 is axially fixed to the cam drive wheel 76 to be able to rotate theretogether.

The area around the first and second cams 20 and 30 is provided with a tube frame 12 (refer to FIG. 1). The tube frame 12 is sandwiched between the lid body 13 and the first frame 11 described above. The components, i.e., the lid body 13, the tube frame 12, and the first frame 11, are overlaid together using a screw that is not shown, and the first and second frames 11 and 14 are also overlaid one on the other using a screw that is not shown. Their connection planes are closely attached to each other. As such, the inner workings of the fluid transfer mechanism 101 and those of the drive transmission section 102 can remain airtight by being enclosed by the components, i.e., the lid body 13, the tube frame 12, and the first and second frames 11 and 14.

By referring to FIG. 1, described next is the fluid transfer mechanism and the operation thereof in the first embodiment.

FIG. 1 shows the first state in which the micropump 10 is in the state of constant driving, and is shown through the lid body 13. In FIG. 1, the fluid transfer mechanism 101 of this embodiment is configured to include the first and second cams 20 and 30, the tube 50, and a plurality of fingers 40 to 46. The first and second cams 20 and 30 are axially fixed to or pivotally supported by the cam drive wheel 76, and the tube 50 serves to feed a fluid therethrough. The fingers 40 to 46 are disposed between the tube 50 and the first and second cams 20 and 30, and are extended radially from the rotation center P of the cam drive wheel 76. These fingers 40 to 46 are disposed at the same angle.

In the first cam 20, the center portion thereof is axially fixed to the shaft portion of the cam drive wheel 76, and the circumferential portion has three protrusions, i.e., three finger depression sections 21*a* to 21*c*. The finger depression sections 21*a* to 21*c* are formed on a concentric circle with the same distance from the rotation center P. The finger depression sections 21*a* and 21*b*, and the finger depression sections 21*b* and 21*c* are each so formed as to share the same circumferential pitch and the same outer shape. Moreover, the interval between the finger depression sections 21*a* and 21*c* is twice of the circumferential pitch of between the finger depression sections 21*a* and 21*b* or between the finger depression sections 21*b* and 21*c*.

Such finger depression sections 21*a* to 21*c* are each formed with, in a row, a finger depression sloped surface 22 and an arc section 23 on the concentric circle around the rotation center P. This arc section 23 is disposed at a position of not depressing the fingers 40 to 46.

The finger depression sections 21*a*, 21*b*, and 21*c* are each connected, at one end portion, to the arc section with a linear section 24, which is an extension from the rotation center P. At the lower portion of the first cam 20, the second cam 30 is pivotally supported by the shaft portion of the cam drive wheel 76. The second cams 30 is allowed to rotate in the plane direction between the linear section 24 of the finger depression section 21*a* and a second cam push-and-move section 26.

In the vicinity of the tip end portion of the finger depression section 21*c* of the first cam 20, a through hole 27 is provided for use as a rotation position detection mark. To the tube frame 12 in the lower rotation range of the first cam 20, light sensing elements 80 and 90 are disposed concentrically to the through hole 27 from the rotation center P (refer to FIGS. 1 and 2). In this embodiment, the light sensing elements 80 and 90 are respectively a light-emitting element and a light-receiving element. When a positional coincidence is observed between the light sensing element 80 or 90 and the through hole 27, the light coming from the light-emitting element passes through the through hole 27, whereby the light-receiving element detects no reflected light. Accordingly, the light-receiving element can detect the rotation position of the through hole 27, i.e., the rotation position of the first cam 20.

The second cam 30 is configured to include a finger depression section 32, the finger depression sloped surface 22, and a finger depression sloped surface 31. The finger depression section 32 is of the same shape as the finger depression sections 21*a*, 21*b*, and 21*c* of the first cam 20 described above.

Described now is the relationship between the first and second cams 20 and 30. The first cam 20 is axially fixed to the shaft portion of the cam drive wheel 76, and thus is rotated together with the cam drive wheel 76 in the direction of an arrow R. The second cam 30 does not follow the first cam 20 to rotate due to the play from the shaft portion of the cam drive wheel 76. However, the second cam 30 is rotated together with the first cam 20 in the direction of the arrow R if a first cam engaging section 38 provided at an end portion 33 of the second cam 30 is coming in contact with the second cam push-and-move section 26 provided at the end portion of the finger depression section 21*c* of the first cam 20, and if the rotation force of the first cam 20 is transmitted from the second cam push-and-move section 26 to the first cam engaging section 38. With this configuration, the end portion 33 of the second cam 30 is so disposed as to have the sufficient space from the linear section 24 of the first cam 20.

In such a state, the finger depression sections 21*a*, 21*b*, 21*c*, and 32 all share the same pitch, and are ready to depress the fingers 40 to 46.

In the first state, the first and second cams 20 and 30 look as a piece of cam including the finger depression sections 21*a*, 21*b*, 21*c*, and 32 at four portions.

Although not shown, the finger depression sections 21*a* to 21*c* and 32 are formed concentrically with respect to the rotation center P, and with the finger depressing area formed by this concentric circle, two of the adjacent fingers are so set as to come in contact.

The tube 50 is provided, for feeding of a fluid, at a position away from these first and second cams 20 and 30 in the peripheral direction. The tube 50 is made elastic, and in this embodiment, is made of silicone rubber. The tube 50 is attached inside of an ark-shaped tube guide groove 121 formed to the tube frame 12, and at one end portion thereof, a fluid outflow port 53 is provided for directing a fluid to the outside. The fluid outflow port 53 is protruding to the outside of the micropump 10. The other end portion of the tube 50 is a fluid inflow port 52 from which a fluid flows in, and the fluid inflow port 52 is connected with a connection tube 55. The end portion of the connection tube 55 is linked through a fluid reserving section 60 (not shown) carrying therein a fluid. Herein, the tube guide groove 121 is so formed that the arc center comes on the rotation center P.

In the tube 50, the area to be depressed by the fingers 40 to 46 is attached in the tube guide groove 121, which is formed concentrically with respect to the rotation center P. Between the tube 50 and the first and second cams 20 and 30, the fingers 40 to 46 are disposed radially from the rotation center P.

The fingers 40 to 46 are of the same shape, and thus the finger 44 is described by way of example. The finger 44 is configured by a cylindrical shaft portion 44*a*, a collar portion 44*c*, and an abutment portion 44*b*. The collar portion 44*c* is provided at one end portion of the shaft portion 44*a*, and the other end portion thereof is rounded like a dome, i.e., the abutment portion 44*b*. The collar portion 44*c* serves to depress the tube 50, i.e., depressing section, and the abutment portion 44*b* is depressed by the first or second cam 20 or 30, i.e., depressing section. Such a finger 44 and other fingers are each attached in a finger guide groove (not shown) provided to the tube frame 12, and are retained by the lid body 13 in the cross-sectional direction.

The fingers 40 to 46 are allowed to move back and forth from/to the rotation center P along the finger guide groove. The fingers 40 to 46 are depressed toward the outside by the first and second cams 20 and 30, and thus depress the tube 50 between them and a tube guide wall 122 so that a fluid flowing section 51 is closed (refer also to FIG. 3). The center portion of each of the fingers 40 to 46 in the cross-sectional direction is almost the same as the center of the tube 50.

By referring to FIG. 1, described next are the effects related to the fluid transfer in this embodiment by referring to FIG. 1. FIG. 1 shows a part of the first state, i.e., the finger 44 is depressed by the finger depression section 32 of the second cam 30, and the finger 45 is abutting a junction portion between the finger depression section 32 and a finger depression sloped surface 31, whereby the fingers 44 and 45 close the tube 50. The finger 46 is depressing the tube 50 on the finger depression sloped surface 31 but the depression by the finger 46 is smaller than that by the fingers 44 and 45, and thus the tube 50 is not completely closed.

The fingers 41 to 43 are all located in the range of an arc section 36 of the second cam 30, i.e., at the initial positions free from depression. The finger 40 is abutting the finger depression sloped surface 22 of the first cam 20, but at this position, the tube 50 is not yet closed.

From such a position, when the first and second cams 20 and 30 are rotated to a further degree in the direction of the arrow R, the finger depression section 32 of the second cam 30 starts depressing the fingers 45 and 46 in this order so that their corresponding portions of the tube 50 become closed. The finger 44 then becomes free from the finger depression section 32 so that the tube 50 is freed from depression on the portion. At the portion of the tube 50 where being free from depression by the finger, or at the portion of the tube 50 where being not yet closed, the fluid is flowing into the fluid flow section 51.

When the first cam 20 is rotated to a further degree, the finger depression sloped surface 22 starts depressing sequentially the fingers 40, 41, 42, and 43 in this order. When the finger depression section 21*c* reaches the abutment portion rounded like a dome in order of the fingers 40, 41, 42, and 43, the tube 50 is sequentially closed.

With such an operation repeatedly performed, the fluid is made to flow from the side of the fluid inflow port 52 to the side of the fluid outflow port 53, thereby being discharged from the fluid outflow port 53, i.e., in the direction of an arrow F.

At this time, to the finger depression section of the first cam 20 and that of the second cam 30, two of the fingers are abutting, and when these sections move to the positions for depressing the next finger, one of the fingers is accordingly depressed thereby. Such repetition of states, i.e., the state that two fingers are depressed and the state that one finger is depressed, forms the state in which at least one finger is always closing the tube 50. As such, even at the time of switching of depressing finger when the first and second cams 20 and 30 are sequentially performing finger depression, any one of the fingers is unfailingly depressed and thus the tube 50 is closed thereby. This accordingly prevents any back-flow of a fluid, and enables the continuous flow of the fluid.

By referring to the accompanying drawings, described in detail now is the configuration of closing the tube 50 by the fingers. In the below, described is an exemplary state in which the finger 44 closes the tube 50.

FIG. 3 is a partial cross-sectional view of the micropump of FIG. 1, showing the plane cut across a line B-B. In FIG. 3, the tube 50 is mostly inserted, in the cross-sectional direction, into the tube guide groove 121 provided to the tube frame 12, and is retained at the position, i.e., indicated by chain double-dashed lines in the drawing.

The finger 44 is attached in the finger guide groove 126 provided to the tube frame 12 to be able to move in the axial direction. At the portion of connecting together the finger guide groove 126 and the tube guide groove 121, a concave section 125 is drilled for the collar portion 44*c* of the finger 44 to move thereover. Below the tube guide wall 122 provided upright to the tube guide groove 121, another concave section is formed to serve as a deformable area when the tube 50 is closed.

Above the tube 50, the lid body 13 is disposed, and the lid body 13 is formed with, at the position corresponding to the tube guide groove 121, a groove of a size to which the tube 50 can be attached. The lid body 13 is also formed with a concave section 131 corresponding to the concave section 125, and another concave section serving as an area into which the tube 50 is allowed to deform when it is closed. When the tube depression section of the first cam 20 or that of the second cam 30 is depressing no finger, the fluid flow section 51 of the tube 50 is not closed. The position of the finger 44 at this time is indicated by chain double-dashed lines.

FIG. 3 shows the state in which the second cam 30 is depressing the finger 44. The finger 44 is depressed by the finger depression section 32, thereby closing the tube 50. Thereafter, when the finger 44 is moved backward and when the tube 50 thus becomes free from the depression thereby, the fluid flow section 51 is put back in shape to its initial position, i.e., back to the position indicated by chain double-dashed lines.

The tube guide section 123 is formed with a sloped surface in the direction of the tube 50, and helps the tube 50 to be back to its initial position. As shown in FIG. 1, this tube guide section 123 is provided at four positions, i.e., in the vicinity of the outside of the finger 40, between the fingers 41 and 42, between the fingers 44 and 45, and in the vicinity of the outside of the finger 46. These tube guide sections 123 serve to help the tube 50 to be back, without fail, from the position being closed to the position being free from depression.

Described next is the assembly of the fingers 40 to 46 and the tube 50. First of all, the finger 44, for example, is attached, by insertion from above, to inside of the finger guide groove 126 formed to the tube frame 12. The tube 50 is then placed inside of the tube guide groove 121, and the lid body 13 is disposed on the resulting structure. This is the end of the assembly.

Note that this assembly order of the fingers 40 to 46 and the tube 50 is not surely restrictive, and may be reversed.

By referring to the drawings, described next is the operation of the micropump 10 for a state change from the second to third.

When the micropump 10 being in the above-described first state (refer to FIG. 1) is stopped in operation for a long period of time, or when the micropump 10 is detected as having been stopped halfway and remained in the halting state for a fixed length of time, the micropump 10 itself operates for a state change to the second and third.

Described first is the operation for a state change from the first to second.

FIG. 4 is a partial plan view showing a part of the fluid transfer device 101 in the second state. In the micropump 10 in the first state (refer to FIG. 1), the first cam 20 is rotated to a further degree in the forward direction, i.e., in the direction of the arrow R. By being pushed by the rotation of the first cam 20, the second cam 30 starts rotating until reaching the position where the finger depression section 32 releases the depression by the finger 46 on the side of the fluid outflow port, i.e., until reaching the position of releasing the tube from depression.

In this state, a positional coincidence is observed, when viewed from above, between the through hole 27 provided to the first cam 20 for use as a rotation position detection mark, and the light sensing element 80 serving as a first detector. The light coming from the light sensing element 80 passes through the through hole 27, and thus no reflected light is detected. Accordingly, the light sensing element 80 is capable of detecting the positional coincidence with the through hole 27 as such.

When the through hole 27 is detected, a detection signal is forwarded to a drive control circuit (not shown), thereby rotating the step rotor 70 (refer to FIG. 2) in the reverse direction. In response, the first cam 20 starts rotating in the reverse direction as is axially fixed to the cam drive wheel 76 moving together with the step rotor 70. At this time, as is axially fixed to the cam drive wheel 76 to be able to rotate, the second cam 30 remains at the position of releasing the depression by the fingers 44 to 46. Herein, the second cam 30 may rotate in the reverse direction due to friction or others, but may not rotate further because a linear section 35 thereof engages with the finger 46.

By referring to the drawings, described next is the operation of the micropump 10 for a state change from the second to third.

FIG. 5 is a partial plan view of the fluid transfer mechanism 101 in the third state. In the micropump 10 in the second state (refer to FIG. 4), only the first cam 20 is rotated to a further degree in the reverse direction, i.e., in the direction of the arrow r, and the through hole 27 reaches the position where a positional coincidence is observed, when viewed from above, with the light sensing element 90 serving as a second detector. The light coming from the light sensing element 90 passes through the through hole 27, and thus no reflected light is detected. Accordingly, the light sensing element 90 is capable of detecting the positional coincidence with the through hole 27 as such.

When the through hole 27 is detected, a detection signal is forwarded to a drive control circuit (not shown), thereby stopping the step rotor 70. The light sensing element 90 is disposed at a position where the finger depression section 21*c* of the first cam 20 releases the tube 50 from depression by the finger 40 on the side of the fluid inflow port 52. As such, in this state, both the first and second cams 20 and 30 are stopped from rotating while being in the state of releasing the tube from depression by all of the fingers, and the first and second cams 20 and 30 both remain in this state until a re-drive start command comes. At this time, between the end portion 33 of the second cam 30 and the linear section 24 of the first cam 20, there is a space needed for the first and second cams 20 and 30 to remain in the state of releasing the tube from depression by all of the fingers.

As an alternative configuration, light-emitting elements may be disposed to the tube frame 12 to serve as the light sensing elements 80 and 90, and a light-receiving element may be disposed at a position opposing the light-emitting element of the lid body 13 to detect light passing through the through hole 27 by the light-receiving element.

Still alternatively, a reflection member may be disposed at the position of the through hole 27 to detect a reflected light by light sensing elements including a light-emitting element and a light-receiving element. If this is the configuration, in the first cam 20, the components other than the reflector member may be finished not to reflect light or may be made of such a material.

As such, in the first embodiment described above, when the micropump 10 completed as a product is not driven until it is used by a user, or is stopped halfway and may not be driven for a long period of time, the micropump 10 remains in the third state of not depressing the tube 50 by the fingers 40 to 46, thereby being able to solve the previous problems, e.g., the problem of the tube 50 remaining deformed and being not back to its original shape due to the continuous depression at the same position of the tube, and the problem of a difficulty in feeding a fluid with a predetermined amount of flow due to the time needed for the tube to be back to its original shape and deterioration of the tube.

What is better, for creating the third state of not depressing the tube 50, the configuration does not require the operation of detaching the tube 50 from the micropump body. This favorably eliminates any troublesome operation of releasing the tube from depression or intentionally releasing the tube from depression, and thus the micropump 10 can remain water resistant in the drive section.

By the through hole 27 serving as a rotation position detection mark and the light sensing elements 80 and 90, the rotation positions of the first and second cams 20 and 30 can be detected with good accuracy.

Moreover, the operation cycle for a state change of the micropump, i.e., from the first to third states, is performed in response to a detection by the first and second detectors. This accordingly eliminates the need for any troublesome operation, e.g., removing the tube 50 from the micropump body, and releasing the tube from depression.

Second Embodiment

By referring to the drawings, described next is a micropump in a second embodiment of the invention. In the second embodiment, characteristically, a rotation position detection mark is provided also to the second cam 30, and a third detector is provided for detecting the rotation position detection mark. The remaining configuration and the effects are the same as those of the first embodiment described above, and thus are not described twice.

FIG. 6 is a partial plan view of the fluid transfer mechanism 101 of the second embodiment, being in a part of the second state. FIG. 7 is a partial cross-sectional view of the fluid transfer mechanism 101 of FIG. 6. In FIGS. 6 and 7, the first cam 20 is formed with the through hole 27 to serve as a rotation position detection mark at the same position as in the first embodiment. The tube frame 12 located at the lower rotation range of the first cam 20 is provided with the light sensing element 90 concentrically to the through hole 27 from the rotation center P (refer to FIG. 2). The light sensing element 90 serves as a second detector.

In the vicinity of the circumferential portion, the finger depression section 32 of the second cam 30 is provided with a through hole 39 for use as a rotation position detection mark of the second cam 30, and the tube frame 12 located in the lower rotation range of the second cam 30 is provided with a light sensing element 91 concentrically to the through hole 39 from the rotation center P (refer to FIG. 7). The light sensing element 91 serves as a third detector, and can be of the same type as the light sensing elements 80 and 90 described in the first embodiment.

In the micropump 10 in the first state (refer to FIG. 1), the first cam 20 is rotated in the forward direction to a further degree, i.e., in the direction of the arrow R. By being pushed by the rotation of the first cam 20, the second cam 30 starts rotating until reaching the position where the finger depression section 32 releases the tube from depression by the finger 46 on the side of the fluid outflow port.

In this state, a positional coincidence is observed, when viewed from above, between the through hole 39 provided to the second cam 30 and the sensing element 91. The light coming from the sensing element 91 passes through the through hole 39, and thus no reflected light is detected so that the light sensing element 91 can detect the positional coincidence with the through hole 39 when viewed from above.

When the through hole 39 is detected, a detection signal is forwarded to a drive control circuit (not shown), thereby rotating the step rotor 70 in the reverse direction. In response, the first cam 20 starts rotating in the reverse direction as is axially fixed to the cam drive wheel 76 moving together with the step rotor 70 (in the second state). At this time, as is axially fixed to the cam drive wheel 76 to be able to rotate, the second cam 30 remains at the position of releasing the tube from depression by the fingers 44 to 46. Herein, the second cam 30 may rotate in the reverse direction due to friction or others, but may not rotate further because the linear section 35 of the finger depression section 32 thereof engages with the finger 46.

By referring to the drawings, described next is the operation of the micropump 10 for a state change from the second to third.

FIG. 8 is a partial plan view of the fluid transfer mechanism 101, being in a part of the third state. In the micropump 10 in the second state (refer to FIG. 6), only the first cam 20 is rotated in the reverse direction, i.e., in the direction of the arrow r, until the through hole 27 reaches the position where a positional coincidence is observed, when viewed from above, with the light sensing element 90. The light coming from the light sensing element 90 passes through the through hole 27, and thus no reflected light is detected. Accordingly, the light sensing element 90 is capable of detecting the positional coincidence with the through hole 27 as such.

When the through hole 27 is detected, a detection signal is forwarded to a drive control circuit (not shown), thereby stopping the step rotor 70. The light sensing element 90 is disposed at a position where the finger depression section 21*c* of the first cam 20 releases the tube from depression by the finger 40 on the side of the fluid inflow port 52. As such, in this state, both the first and second cams 20 and 30 are stopped from rotating while being in the state of releasing the tube from depression by all of the fingers, and the first and second cams 20 and 30 both remain in this state until a re-drive start command comes.

As such, in the second embodiment described above, as the position where the finger depression section 32 of the second cam 30 releases the tube from depression by the fingers 40 to 46, the through hole 39 of the second cam 30 for use as a rotation position detection mark is detected by the light sensing element 91 serving as the third detector, and right after the detection, the second cam 30 can be stopped from rotating. The relative position between the rotation position detection marks of the first and second cams 20 and 30, i.e., the through holes 27 and 39, is defined by the design shape of the first and second cams 20 and 30. As such, by rotating only the first cam 20 in the reverse direction, and by stopping the first cam 20 from rotating after detecting the through hole 27 thereof using the light sensing element 90, i.e., second detector, the first and second cams 20 and 30 can properly remain in the third state of releasing the tube 50 from depression by the fingers 40 to 46.

Third Embodiment

Described next is a third embodiment. In the third embodiment, characteristically, the driving amount of the first cam at the time of a state change from second to third is controlled by the number of drive pulses of a step motor. The first embodiment is described for comparison use. The third embodiment includes the through hole 27 as a rotation position detection mark, and the light sensing element 80 as a first detector. Unlike the first embodiment, the light sensing element 90 as a second detector is not in need.

First of all, for a state change from first to second, the first cam 20 is rotated in the forward direction, and when the through hole 27 is detected as reaching the position of the light sensing element 80, the first cam 20 is stopped from rotating, i.e., corresponds to the second state of FIG. 4, and immediately thereafter, the first cam 20 is rotated in the reverse direction. At this time, the step motor 65 is provided with the required number of drive pulses, and the motor is then stopped from rotating. The number of drive pulses here are those needed for the first cam 20 to reach the position where the finger 40 to 46 leave open the tube 50, i.e., the position corresponding to the light sensing element 90 in the first embodiment.

The rotation angle from the stopping position for the first cam 20 in the second state to the stopping position therefor in the third state is determined by the design dimension of the first cam 20. As such, the drive pulses corresponding to the movement angle may be provided.

As such, the movement amount of the first cam 20 until reaching the position of releasing the depression by the fingers 40 to 46 is provided with the number of drive pulses of a step motor. This thus eliminates the need for the second detector as described above, thereby favorably simplifying the configuration.

Such a configuration can be applied to the second embodiment. In this configuration, the second cam 30 is provided with the through hole 39 as a rotation position detection mark, and the third detector is the light sensing element 91. The configuration does not require the through hole 27 for the first cam 20 and the light sensing elements 80 and 90.

For a state change from first to second, the second cam 30 is rotated in the forward direction in response to the rotation of the first cam 20, and when the through hole 39 reaches the position of the light sensing element 91, the first and second cams 20 and 30 are stopped from rotating, and immediately thereafter, the first cam 20 is rotated in the reverse direction. At this time, the step motor 65 is provided with the required number of drive pulses for the first cam 20 to reach the position where the fingers 40 to 46 leave open the tube 50, i.e., the position corresponding to the light sensing element 90 in the first embodiment. After such pulse provision, the first cam 20 is stopped from rotating.

The rotation angle from the stopping position for the second cam 30 in the second state to the stopping position for the first cam 20 in the third state is determined by the design dimension of the first and second cams 20 and 30. As such, the drive pulses corresponding to the movement angle may be provided.

As such, the movement amount of the first cam 20 in the second state until reaching the position of the third state is provided with the number of drive pulses of a step motor. This thus eliminates the need for the through hole 27 and the first and second detectors as described above, thereby favorably simplifying the configuration.

Alternatively, as means for driving, in the reverse direction, the first cam 20 until reaching the position of the third state, a timer may be provided to the drive control circuit for allowing driving only a predetermined length of time.

Fourth Embodiment

Described next is a fourth embodiment. Compared with the configurations of the first to third embodiments described above, in the fourth embodiment, characteristically, a rotation position detection mark and a detector are of contact mode. Although not shown, a description is given by referring to FIGS. 1 to 8.

In the fourth embodiment, a rotation position detection mark of the first cam 20 and that of the second cam 30 are each made of a conductive material. The first to third detectors are each made of an elastic material with conductivity. The conductive member is disposed at the position of the above-described rotation position detection mark, and the elastic member is disposed at a non-movable portion of the micropump, e.g., the tube frame 12.

The detection of the first and second cams 20 and 30 in the second and third states is made by the conductive member and the elastic member being electrically connected through abutment therebetween. If the first and second cams are each made of metal, the conductive member may be disposed with insulation therefrom, and if the cams are each made of an insulator material, the conductive member may be disposed as it is. The conductive member is provided with a terminal for establishing a connection to a drive control circuit at least at the detection position, and the elastic member is connected to the drive control circuit using a lead or others.

As an alternative configuration, the rotation position detection mark may be an elastic member with conductivity, and the first to third detectors may be each a conductor member.

Fifth Embodiment

Described next is a fifth embodiment. In the fifth embodiment, compared with the configurations of the first to fourth embodiments described above, characteristically, a rotation position detection mark and a detector are of magnetic field detection mode. Although not shown, a description is given by referring to FIGS. 1 to 8.

In this embodiment, a rotation position detection mark provided to each of the first and second cams 20 and 30 is a permanent magnet. The first to third detectors are each a Hall device. The permanent magnet is fixed at the position of the rotation position detection mark described above, and the Hall device is fixed to a non-movable portion of the micropump, e.g., the tube frame 12.

The detection of the first and second cams 20 and 30 in the second and third states is made by detecting the magnetic field of the permanent magnet using the Hall device, and by converting the resulting magnetic field into a voltage. The peak position of the detected voltage value is the desired detection position. The Hall device is connected to a drive control circuit using a lead or others. Note here that, in the permanent magnet, the portion opposing the Hall device may be reduced in diameter or shaped acute at the tip, thereby improving the level of detection.

Herein, when the first and second cams 20 and 30 are each made of metal, the permanent magnet may be disposed with insulation and a space therefrom, and when the cams are each made of an insulator material, the permanent magnet may be disposed as it is.

Alternatively, a rotation position detection mark may be a Hall device, and the first to third detectors may be each a permanent magnet. With this configuration, the first and second cams 20 and 30 are not restrictive in material.

Accordingly, the configurations of the third to fifth embodiments described above are all simple, and can detect the rotation positions of the first and second cams 20 and 30 with good accuracy. Because the detections are all made electrically, there are also advantages of easy feedback of such detection. Especially, the configuration of the third embodiment can be implemented with a lower cost, and in the fifth embodiment, the power consumption at the time of driving can be reduced.

Sixth Embodiment

Described next is a sixth embodiment. In the sixth embodiment, characteristically, when a micropump remains stopped for a fixed length of time, the micropump is automatically made to operate to be in the third state. The configuration of the micropump in the sixth embodiment is the same as those in the first to fifth embodiments described above, and thus is not described again. In the below, the configuration of the first embodiment is described by way of example (refer to FIGS. 1 to 5).

In the sixth embodiment, a drive control circuit is provided with a timer. This timer starts counting the time when the micropump 10 is stopped halfway after being driven for a predetermined length of time. When the duration of stopping exceeds a fixed length of time, e.g., several hours, driving of the micropump 10 is started, i.e., micropump is put in the first state. Thereafter, when the through hole 27 of the first cam 20 reaches the position of a light sensing element, i.e., second state, only the first cam 20 is rotated in the reverse direction until reaching the position of the light sensing element 90, and then is stopped, i.e., third state. That is, the first and second cams 20 and 30 are stopped in the state of releasing the tube 50 from depression by the fingers 40 to 46.

After the lapse of a fixed length of time after the micropump is stopped, the drive control circuit executes a sequence of operations for a state change from the first to third states. As such, the micropump can remain in the third state without a user executing any specific operation for this operation.

Seventh Embodiment

Described next is a seventh embodiment. In the seventh embodiment, the above-described function of detecting the rotation position is used to detect the driving state of the micropump. The configuration of the micropump in the seventh embodiment is the same as those in the second to fifth embodiments described above, and thus is not described again. In the below, the configuration of the second embodiment is described by way of example.

When the micropump 10 is in the state of constant driving, i.e., in the first state of feeding a fluid, the first cam 20 is rotating with any predetermined number of drive pulses. In response, the through hole 27 is rotated, and is then detected as passing through the position of the light sensing element 90. When the micropump is in the state of constant driving, the first cam 20 is being rotated at a predetermined rotation speed under any required driving conditions.

Note here that the distance of the through hole 39 of the second cam 30 from the rotation center P is set to a value different somewhat from the distance of the through hole 27 of the first cam 20 therefrom not to invite any erroneous detection.

As such, the time needed for the first cam 20 to rotate once or the number of drive pulses for the duration is calculated for comparison with the rotation speed in the driving conditions, thereby being able to determine the actual driving state. For example, if the tube 50 is clogged, the load is increased and the rotation speed may be thus reduced. Moreover, the drive pulses may vary due to any failure of the driving control circuit, and the rotation speed may be fluctuated. When such an abnormal rotation speed is detected, the step motor 65 is stopped from driving at once. This favorably increase the safety for provision of fluid drug preparations.

Eighth Embodiment

Described next is an eighth embodiment. In the eighth embodiment, characteristically, an external detector is provided outside of a micropump, and a command comes from the outside for the operation for a state change from the first to third states. Although not shown, a description is given by referring to FIGS. 1 to 5. In this embodiment, the micropump 10 is provided with a communications device, which is connected to a drive control circuit. In this embodiment, for example, the lid body 13 is made of a transparent material, and from the outside of the lid body 13, the components are visible from above, i.e., the first and second cams 20 and 30, and the fingers 40 to 46.

The communications device is exemplified by a radio communications system or a cable communications system.

Above the micropump 10, an external detector is disposed at a position from which the first and second cams 20 and 30, and the fingers 40 to 46 are visible, i.e., their plane shapes and relative positions. The external detector includes an imaging element and an image processing device. The external detector acknowledges the first and second cams 20 and 30, and the fingers 40 to 46 each as an image, and by the relative shapes of these components, i.e., the first and second cams 20 and 30, and the fingers 40 and 46, the first to third states can be acknowledged.

That is, when the image processing device acknowledges that the second cam 30 has freed the finger 46, i.e., state of FIG. 4, a detection signal is forwarded to the drive control circuit via the communications device, thereby immediately rotating the first cam 20 in the reverse direction. When the image processing device acknowledges that the first cam 20 reaches the position of releasing the tube by the finger 40, i.e., state in FIG. 5, a detection signal is forwarded to the drive control circuit via the communications device, thereby stopping the first cam 20.

This configuration enables, using an external detector as such, the operation for a state detection and change of the micropump, i.e., from the first to third states, in accordance with the driving state of the micropump 10. There thus are effects of, after the micropump is checked for its feeding amount of fluid before shipment, for example, keeping the micropump in the third state until it is used by a user.

This configuration also eliminates the need for the micropump to carry therein a detector(s), whereby the resulting micropump can be favorably simplified in configuration. This accordingly leads to the cost reduction of the micropump, and the economic effects can be increased for users when the micropump is thrown away after one use.

Alternatively to the configuration of the eighth embodiment, the first and second cams 20 and 30 may be each provided with a permanent magnet for use as a rotation position detection mark, and the external detector may be provided with a Hall device. With such a configuration, if the distance between the permanent magnet and the Hall device is set to a value available for detection of a magnetic field, the lid body 13 is not restricted in material unless it is metal.

Still alternatively, the first and second cams 20 and 30 may be provided with a reflection member as a rotation position detection mark, and the external detector may be provided with a light sensing element. With such a configuration, the lid body 13 may be made of a light transmissive material, and the light coming from the light sensing element may be detected by a light reflected by the reflection member.

Ninth Embodiment

Described next is a micropump in a ninth embodiment. Compared with the above-described configurations of the first to eighth embodiments in which a detector detects the position of a rotation position detection mark, in the ninth embodiment, characteristically, the number of drive pulses of a motor is counted for use to control the first and second cams in terms of the rotation amount and the stop position so that an initial state is favorably created. Such a ninth embodiment is described by referring to FIGS. 1 to 6. Note that, the configuration in the ninth embodiment does not require a rotation position detection mark and a detector. The remaining configuration is the same as that of the first embodiment (refer to FIG. 1), and thus is not described again.

First of all, the micropump 10 is so assembled, as shown in FIG. 5, as to be in the initial state, i.e., the tube 50 is left open by the first and second cams 20 and 30 not depressing the fingers 40 to 46. From this initial state, the driving of the micropump is stated.

The micropump 10 is driven in response to an input of drive pulses to the step motor 65. FIG. 1 shows the state during driving. Through such driving, a fluid is discharged from the fluid outflow port 53 with a predetermined fluid-feeding speed. At this time, at least either the first or second cam 20 or 30 depresses any of the fingers 40 to 46, thereby closing the tube 50.

While the micropump 10 is being driven, the number of accumulated drive pulses is counted from the initial state. Such counting of the number of drive pulses is performed by a counter provided to a drive control circuit (not shown). When the first cam 20 reaches a predetermined rotation frequency, i.e., predetermined amount of flow, or in the immediate range, when the number of accumulated drive pulses from the initial state reaches the integral multiple of the number of drive pulses needed for the first cam 20 to rotate once, i.e., when the first cam 20 reaches the position of the initial state, the first cam 20 is rotated to a further degree by an additional input of the drive pulses until reaching the initial state, and then is stopped. The relative position between the first and second cams 20 and 30 is the state of FIG. 4.

Alternatively, the step motor 65 may be driven by an addition result of the drive pulses, i.e., the additional number of drive pulses being a design value set in advance plus the number of accumulated drive pulses from the initial state, i.e., the integral multiple of the drive pulses needed for the first cam 20 to rotate once.

Thereafter, the step motor 65 is stopped with an input of the drive pulses needed for bringing the first cam 20 to the position of the initial state through rotation in the reverse direction. At this time, only the first cam 20 is rotated in the reverse direction, and the second cam 30 remains at the same position, thereby putting both the first and second cams 20 and 30 in the initial state as shown in FIG. 5. Note here that the number of drive pulses needed for the first cam 20 to reach the position of the initial state through rotation in the reverse direction is the same as the number of drive pulses being the above-described additional input.

According to this embodiment, the initial state is created when the micropump 10 is assembled, and when the first cam 20 reaches a predetermined rotation frequency, i.e., reaches a predetermined amount of flow, the step motor is provided with an input of the drive pulses needed to put the second cam 30 in the initial state. Thereafter, the first cam 20 is rotated in the reverse direction, and then the step motor is provided with an input of any needed drive pulses so that the first cam 20 is moved to the position of the initial state, and then is stopped. As such, by making an input of drive pulses needed for the step motor 65 without using a rotation position detection mark and a detector, the micropump 10 can be stopped in operation while being in the initial state of leaving open the tube.

Tenth Embodiment

By referring to the drawings, described next is a tenth embodiment. In the tenth embodiment, after the second cam 30 reaches the initial state, the step motor 65 is rotated in the reverse direction so that the second cam 30 is engaged with the finger 46 at the tail in the fluid-feeding direction. When the load of the motor is detected as being excessive due to the engagement, the step motor 65 is stopped so that the initial state is created. Note that, in the tenth embodiment, a rotation position detection mark and a detector are not in need.

FIG. 9 is a partial plan view of the first and second cams 20 and 30, being in the initial state, and FIG. 10 is a partial plan view showing the state in which only the second cam is rotated to the position of the initial state. As shown in FIG. 9, the micropump 10 is so assembled that the tube 50 is left open by the first and second cams 20 and 30 not depressing the fingers 40 to 46, i.e., in the initial state. From this initial state, driving of the micropump is stated.

Driving of the micropump 10 is started in response to an input of drive pulses to the step motor 65. FIG. 1 shows the state during driving. Through such driving, a fluid is discharged from the fluid outflow port 53 with a predetermined fluid-feeding speed. At this time, at least either the first or second cam 20 or 30 depresses any of the fingers 40 to 46, thereby closing the tube 50.

While the micropump 10 is being driven, the number of accumulated drive pulses is counted from the initial state, i.e., activation. Such counting of the number of drive pulses is performed by a counter provided to a drive control circuit (not shown). When the first cam 20 reaches a predetermined rotation frequency, i.e., predetermined amount of flow, or in the immediate range, when the number of accumulated drive pulses from the initial state reaches the integral multiple of the number of drive pulses needed for the first cam 20 to rotate once, i.e., when the first cam 20 reaches the position of the initial state, the first cam 20 is rotated to a further degree by an additional input of the drive pulses until the second cam 30 reaches the initial state, and then is stopped. The relative position between the first and second cams 20 and 30 is the state of FIG. 10.

Thereafter, the first cam 20 is rotated in the reverse direction. At this time, the second cam 30 is rotated also in the reverse direction, i.e., in the direction of the arrow r, because the end portion 33 thereof is pushed and moved by the linear section 24 of the first cam 20. However, the second cam 30 is not allowed to rotate that much because the linear section 35 thereof is engaged with a shaft portion 46*a* of the finger 46 at the tail in the fluid-feeding direction. If another input of drive pulses is made in this state, the step motor 65 is put under the excessive load, thereby hindering normal driving. When the motor is rotated, a reverse-induced current is generated, and when the step motor 65 is put under the excessive load and any normal driving is impossible, the waveform of reverse-induced current is observed with fluctuations. When any change is detected in the waveform of reverse-induced current, the input of the drive pulses to the step motor 65 is stopped.

Note that the first cam 20 is so shaped as to be able to rotate in the reverse direction at any rotation position. Specifically, as shown in FIGS. 9 and 10, the first cam 20 forms a sloped surface section 25 serving as a tangent of the arc section 23 from the apex of each of the finger depression sections 21*b* and 21*c*. With the sloped surface section 25 provided as such, the first cam 20 is allowed to rotate in the reverse direction with no engagement with the shaft portions of the fingers 40 to 46.

The first cam 20 is also so shaped as to push and move the second cam 30 while rotating in the reverse direction, and in the state that the second cam 30 is engaged with the shaft portion of the finger 46, as to be located at the position of the initial state of not pushing and moving other fingers.

As such, when driving of the micropump 10 is started from the initial state but is intentionally stopped, only the second cam 30 is moved to the position of the initial state. With the second cam 30 remained at the same position, when the first cam 20 is rotated in the reverse direction, the second cam 30 starts rotating in the reverse direction as is pushed and moved thereby, but is not rotated that much as is engaged with the finger 46 at the tail in the fluid-feeding direction. This resultantly puts the step motor 65 under the excessive load, thereby causing fluctuations in the waveform of reverse-induced current, which is generated when the step motor 65 is rotated. When any change is detected in the waveform of reverse-induced current, the input of the drive pulses to the step motor 65 is stopped. As such, when the first cam 20 is stopped from rotating, the first and second cams 20 and 30 are both located at the positions in the initial state, thereby being able to keep the state of leaving open the tube 50.

Alternatively, the first and second cams 20 and 30 can be put back in the initial state as described in the ninth or tenth embodiments above by detecting the micropump as being intentionally stopped during operation, or detecting the micropump as being remained in the halting state for a predetermined length of time or longer.

As such, both the first and second cams 20 and 30 can be automatically put back in the initial state with no special operation, and both the first and second cams 20 and 30 can remain in the initial state of releasing a tube from depression by fingers. This thus enables to solve many problems, e.g., the feeding of a fluid is prevented because the tube 50 remains deformed due to the continuous depression at any specific portion of the tube 50, and any desired amount of flow for feeding cannot be derived because the tube does not return to its original shape.

The micropump 10 of the embodiments of the invention can be mounted in or out of various types of mechanical devices, and can be used to transfer a fluid such as water, salt water, fluid preparations, oil, aromatic fluid, and ink, or a gas. The micropump can be solely used to flow and feed such a fluid.

What is claimed is:

1. A micropump comprising:

a tube frame including an elastic tube, and a tube guide groove for attachment of the tube in the form of an arc;

a cam drive wheel whose rotation center is the same as an arc center of the tube guide groove, and moves in response to a motor that can be rotated in forward and reverse directions;

a first cam that is axially fixed to a center axis of the cam drive wheel, and is provided with a finger depression section at a circumferential portion thereof;

a second cam that is pivotally supported by the center axis of the cam drive wheel to be able to rotate, and is provided with a finger depression section at a circumferential portion thereof; and a plurality of fingers provided between the tube and the respective finger depression sections of the first and second cams radially from the rotation center, wherein the micropump can be in a first state of continuously feeding a fluid by, when the first cam is rotated in the forward direction, the first cam pushing and rotating the second cam in the same direction, by the finger depression sections of the first and second cams respectively depressing the fingers one by one, and by the fingers sequentially closing and opening the tube repeatedly from a fluid inflow side to a fluid outflow side, a second state of rotating only the first cam in the reverse direction at a time of, in the first state, a detection of a position where the finger depression section of the second cam releases the tube from depression by the fingers, and a third state of stopping the first cam from rotating at a time of, in the second state, a detection of a position where the first cam releases the tube from depression by the fingers, and the first state is retained by a drive command coming from the micropump being in the third state.

2. The micropump according to claim 1, wherein the first cam is provided with a rotation position detection mark, and the micropump further includes:

a first detector that detects whether, in the first state, the rotation position detection mark reaches the position where the second cam releases the tube from depression by the fingers; and a second detector that detects whether, in the second state, the rotation position detection mark reaches the position where the first cam releases the tube from depression by the fingers.

3. The micropump according to claim 1, wherein the first and second cams are respectively provided with a rotation position detection mark, and the micropump further includes:

a first detector that detects whether, in the first state, the rotation position detection mark of the second cam reaches the position where the second cam releases the tube from depression by the fingers; and a second detector that detects whether, in the second state, the rotation position detection mark of the first cam reaches the position where the first cam releases the tube from depression by the fingers.

4. The micropump according to claim 1, wherein the first cam is provided with a rotation position detection mark, the micropump further includes a first detector that detects whether, in the first state, the rotation position detection mark reaches the position where the second cam releases the tube from depression by the fingers, and the motor is provided with the required number of drive pulses until, in the second state, the first cam located at the position detected by the first detector reaches the position of releasing the tube from depression by the fingers, and the motor is stopped.

5. The micropump according to claim 1, wherein the second cam is provided with a rotation position detection mark, the micropump further includes a first detector that detects whether, in the first state, the rotation position detection mark reaches the position where the finger depression section of the second cam releases the tube from depression by the fingers, and the motor is provided with the required number of drive pulses until, in the second state, the first cam located at the position detected by the third detector reaches the position of releasing the tube from depression by the fingers, and the motor is stopped.

6. The micropump according to claim 1, wherein a rotation position detection mark provided to the first or second cam is a light transmissive hole or a light reflection member, and at least one detector is a light sensing element.

7. The micropump according to claim 1, wherein a rotation position detection mark provided to the first or second cam is a conductive member or an elastic member with conductivity, at least one detector that is an elastic member with conductivity or a conductive member, and through connection between the conductive member and the elastic member, a rotation position of the first or second cam is detected.

8. The micropump according to claim 1, wherein a rotation position detection mark provided to the first or second cam is a magnet or a Hall device, and at least one detector that is a Hall device or a magnet.

9. The micropump according to claim 1, wherein the micropump is detected as being stopped for a fixed length of time or longer, the micropump is activated to operate for the first to third states, and the first and second cams are respectively stopped at the positions of releasing the tube from depression by the fingers.

10. The micropump according to claim 1, wherein a time for the first cam in the first state to rotate once is detected by at least one detector.

11. The micropump according to claim 10, further comprising a communications device that outputs a detection result from said at least one detector.

12. A micropump comprising:

a tube frame including an elastic tube, and a tube guide groove for attachment of the tube in the form of an arc;

a cam drive wheel whose rotation center is the same as an arc center of the tube guide groove, and moves in response to a motor that can be rotated in forward and reverse directions;

a first cam that is axially fixed to a center axis of the cam drive wheel, and is provided with a finger depression section at a circumferential portion thereof;

a second cam that is pivotally supported by the center axis of the cam drive wheel to be able to rotate, and is provided with a finger depression section at a circumferential portion thereof; and a plurality of fingers provided between the tube and the respective finger depression sections of the first and second cams radially from the rotation center, wherein the micropump can be in a first state of continuously feeding a fluid by, when the first cam is rotated in the forward direction, the first cam pushing and rotating the second cam in the same direction, by the finger depression sections of the first and second cams respectively depressing the fingers one by one, and by the fingers sequentially closing and opening the tube repeatedly from a fluid inflow side to a fluid outflow side, a second state of rotating only the first cam in the reverse direction at a time of, in the first state, a detection of a position where the finger depression section of the second cam releases the tube from depression by the fingers, and a third state of stopping the first cam from rotating at a time of, in the second state, a detection of a position where the first cam releases the tube from depression by the fingers, a communications device is provided, the positions in the second and third states are respectively detected by an external detector, and a detection result is provided via the communications device, and the micropump is operated for the first to third states.

13. A micropump comprising:

a tube frame including an elastic tube, and a tube guide groove for attachment of the tube in the form of an arc;

a cam drive wheel whose rotation center is the same as an arc center of the tube guide groove, and moves in response to a motor that can be rotated in forward and reverse directions;

a first cam that is axially fixed to a center axis of the cam drive wheel, and is provided with a finger depression section at a circumferential portion thereof;

a second cam that is pivotally supported by the center axis of the cam drive wheel to be able to rotate, and is provided with a finger depression section at a circumferential portion thereof; and a plurality of fingers provided between the tube and the respective finger depression sections of the first and second cams radially from the rotation center, wherein calculations are made of the number of pulses, of the motor, needed for the first cam to rotate once, and for the first cam in an initial state to come in contact with the second cam, and from the total number of pulses driven from start to stop, a calculation is made of the number of pulses needed to bring the first and second cams to the positions when the motor is stopped, and to put the first and second cams in the initial state, and the initial state is created by driving the motor in the forward or reverse direction.

14. The micropump according to claim 13, wherein after continuous driving until a predetermined rotation frequency is derived for the first cam through repeated closing and opening of the tube in the initial state sequentially from a fluid inflow side to a fluid outflow side, the motor is stopped after being provided with, additionally, the number of drive pulses needed for the second cam to be in the initial state, and then with the number of drive pulses needed for the first cam rotating in the reverse direction to reach a position of the initial state.

15. The micropump according to claim 13, wherein after continuous driving until a predetermined rotation frequency is derived for the first cam through repeated closing and opening of the tube in the initial state sequentially from a fluid inflow side to a fluid outflow side, the motor is provided with, additionally, the number of drive pulses needed for the second cam to be in the initial state, and the motor is rotated in the reverse direction to detect a condition of not being able to rotate any more due to an excessive motor load as a result of engagement between the second cam and the finger at a tail in a fluid-feeding direction, and the initial state is created by stopping the motor.

16. The micropump according to claim 13, wherein the motor is detected as being stopped during driving of the micropump or as being remained stopped for a fixed length of time or longer, and the initial state is created by rotating the motor in the forward or reverse direction from each of the number of drive pulses.

* * * * *